US007953338B2

(12) United States Patent
Takagi

(10) Patent No.: US 7,953,338 B2
(45) Date of Patent: May 31, 2011

(54) HEATING APPARATUS, FIXING APPARATUS, AND IMAGE FORMING APPARATUS WHICH CHARGES AN AUXILIARY POWER UNIT TO LESS THAN A MAXIMUM VALUE IN A STANDBY STATUS

(75) Inventor: Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 432 days.

(21) Appl. No.: 11/457,291

(22) Filed: Jul. 13, 2006

(65) Prior Publication Data

US 2007/0025754 A1 Feb. 1, 2007

(30) Foreign Application Priority Data

Jul. 29, 2005 (JP) ..... 2005-221626

(51) Int. Cl.
*G03G 15/20* (2006.01)

(52) U.S. Cl. ..... 399/88; 399/69

(58) Field of Classification Search ..... 399/88, 399/69; 219/216

See application file for complete search history.

(56) References Cited

U.S. PATENT DOCUMENTS 6,542,705 B2 * 4/2003 Fujita et al. ..... 399/69
6,915,088 B2 * 7/2005 Nakagawa et al. ..... 399/66
7,127,189 B2 * 10/2006 Takamatsu et al. ..... 399/69
7,239,821 B2 * 7/2007 Matsusaka et al. ..... 399/69
2002/0067145 A1 * 6/2002 Ribarich ..... 315/291
2003/0228166 A1 * 12/2003 Nakagawa et al. ..... 399/66
2004/0245235 A1 * 12/2004 Kishi et al. ..... 219/216
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0123315 A1 6/2005 Kishi et al.
2005/0139584 A1 6/2005 Kishi et al.
2005/0175368 A1 8/2005 Matsusaka et al.
2005/0175370 A1 8/2005 Matsusaka et al.
2005/0191078 A1 9/2005 Kishi et al.

(Continued)

FOREIGN PATENT DOCUMENTS

EP 1531370 A1 * 5/2005

(Continued)

OTHER PUBLICATIONS

Japanese Office Action for JP 2005-221626, mailed Nov. 2, 2010.

*Primary Examiner* — Quana M Grainger
(74) *Attorney, Agent, or Firm* — Oblon, Spivak, McClelland, Maier & Neustadt, L.L.P.

(57) ABSTRACT

A disclosed heating apparatus comprises: a heat generator for receiving electric power supply from a main power source and an auxiliary power unit and generating heat; a heating unit heated by the heat generator; a charging unit for charging the auxiliary power unit with electric power from the main power source; and a control unit configured to control electric power supply to the heat generator. A first maximum value of electric energy charged in the auxiliary power unit in a standby status is less than a second maximum value of electric energy capable of being charged in the auxiliary power unit.

22 Claims, 8 Drawing Sheets

U.S. PATENT DOCUMENTS

| | | | | |
|---|---|---|---|---|
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0133846 | A1* | 6/2006 | Okamoto | 399/88 |

FOREIGN PATENT DOCUMENTS

| | | |
|---|---|---|
| JP | 10-282821 | 10/1998 |
| JP | 2002-174988 | 6/2002 |
| JP | 2002-278355 | 9/2002 |
| JP | 2003-257590 | 9/2003 |
| JP | 2004-119390 | 4/2004 |
| JP | 2004-287002 | 10/2004 |
| JP | 2005-073468 | 3/2005 |

* cited by examiner

HEATING APPARATUS, FIXING APPARATUS, AND IMAGE FORMING APPARATUS WHICH CHARGES AN AUXILIARY POWER UNIT TO LESS THAN A MAXIMUM VALUE IN A STANDBY STATUS

BACKGROUND OF THE INVENTION

1. Field of the Invention

The present invention relates to an improvement of power-saving capabilities of heating apparatuses and fixing apparatuses, especially to an improvement of power-saving capabilities of image forming apparatuses such as copying machines and printing apparatuses using an electrophotographic method, for example, facsimile machines, and the like.

2. Description of the Related Art

In recent years, the importance of environment issues has been acknowledged and the power-saving capabilities of image forming apparatuses such as copying machines, printing apparatuses, and the like have been improved. In order to improve the power-saving capabilities of these image forming apparatuses, it is effective to lower the temperature of heating units such as a fuser roller and a fuser belt of a fixing apparatus when an image forming apparatus is not feeding paper (in a standby status, for example). However, if the temperature of the heating units is lowered in such a non-paper-feed status, the temperature of the heating units must be raised to a certain temperature again for enabling fixing when the fixing apparatus is used, so that a user must wait until the temperature is raised. As a result, the image forming apparatus requires time to be enabled, so that the usability of such an image forming apparatus is decreased.

In order to avoid this, it is possible to reduce time for raising the temperature of the heating units by supporting electric power supply from an auxiliary power unit to a heat generator of the heating units. There is another method for utilizing electric power in a more effective manner by supporting the electric power supply from the auxiliary power unit to the heat generator of the heating units not only when the temperature of the heating units is raised (in a starting-up status and a return status from an off mode) but also in a paper-feed status.

In this case, "the standby status" refers to a status from an end of an image forming job to a start of the next image forming job, a status from an end of all the image forming jobs to the off mode, and a status (where image forming is enabled) from when the temperature of the heating units is raised to a start of an image forming job, the temperature being raised (reloaded) to such a temperature as to enable image forming after a main power source is turned on or the apparatus is returned from the off mode.

The "off mode" refers to a status where the electric power supply to the heat generator is stopped (in preparation for returning to the next fixing-enabled status) until either one of the following operations (1) and (2) is performed.

(1) A user presses a power source switch (not a main power source switch) of a body of the image forming apparatus.

(2) An external signal such as an image forming start signal or the like is input.

Patent Document 1 discloses an image forming apparatus including a fixing unit configured to heat and fix a toner image, in which the image forming apparatus has an auxiliary energy source for energizing the fixing unit besides a main power source.

Patent Document 2 discloses a fixing apparatus including an electric power adjusting unit for adjusting and supplying electric power to a heat generating unit based on the temperature of a heating unit detected by a temperature detecting unit and residual electric energy of an auxiliary power supply unit detected by a residual electric power detecting unit.

Patent Document 3 discloses a heating apparatus in which a heating unit has a main heat generator for generating heat using electric power supplied from a main power unit and an auxiliary heat generator for generating heat using electric power supplied from an auxiliary power unit. The auxiliary heat generator includes a large-capacity capacitor capable of charging and discharging and a charger charges a capacitor of the auxiliary power unit with electric power supplied from the main power unit. A main switching unit turns on/off electric power supplied from the main power unit to the main heat generator. An auxiliary switching unit turns on/off electric power supplied from the main power unit to the charger. An auxiliary power source switching unit switches between the charge of the auxiliary power unit using the charger and the electric power supply from the auxiliary power unit to the auxiliary heat generator. And a control unit turns on the auxiliary switching unit when the main switching unit is turned off and turns off the auxiliary switching unit when the main switching unit is turned on.

Patent Document 4 discloses a heating apparatus having a heating unit, main power unit, and auxiliary power unit. The heating unit has a heat generator and generates heat using electric power supplied from the main power unit and the auxiliary power unit. The auxiliary power unit has a capacitor. The heating apparatus enables electric power supply from the main power unit and the auxiliary power unit to the heating unit, connects the main power unit to the auxiliary power unit when charging the auxiliary power unit, and supplies electric power from the main power unit to the auxiliary power unit.

Patent Document 1: Japanese Laid-Open Patent Application No. 10-282821

Patent Document 2: Japanese Laid-Open Patent Application No. 2002-278355

Patent Document 3: Japanese Laid-Open Patent Application No. 2003-257590

Patent Document 4: Japanese Laid-Open Patent Application No. 2004-119390

In the above methods, the maximum value of electric energy to be charged in the auxiliary power unit is constant in the standby status and in the preparation for returning to the next fixing-enabled status. In other words, there is only one threshold of control for ending the charge of the auxiliary power unit (a threshold when determining whether the charge of the auxiliary power unit is ended by comparing electric energy charged in the auxiliary power unit with the threshold). When the "return status" is compared with the "paper-feed status", the "return status" requires more electric energy supplied to the heat generator, so that electric energy required to be supplied to the heat generator upon returning must always be charged in the auxiliary power unit.

Thus, in the paper-feed status, excessive electric power is supplied to the heat generator from the auxiliary power unit. Accordingly, when a small number of pieces of paper are fed repeatedly, using three pieces of paper at one time or using five pieces of paper at one time, for example, it is feared that abnormal temperature rising may be caused in the heating units by supplying excessive electric power to the heat generator from the auxiliary power unit.

In other words, in the return status where the temperature of the heating units is returned to a temperature for enabling fixing from the off mode, it is necessary to supply the heat generator with a large amount of electric energy from the auxiliary power unit in order to raise the temperature of the heating units to the temperature for enabling fixing in a short time. However, the heating units reach sufficient temperature in the standby status, so that it is not necessary to supply the heat generator with a large amount of electric energy from the auxiliary power unit in the paper-feed status following the standby status. Further, there has been a problem in that the heating units are excessively heated and abnormal temperature rising may be caused in the heating units upon repeating the feeding of a small number of pieces of paper if excessive electric power is charged in the auxiliary power unit in the standby status and than discharged from the auxiliary power unit to the heat generator in the paper-feed status.

Moreover, when repeating the feeding of a small number of pieces of paper, if the maximum electric energy charged in the auxiliary power unit in the standby status is limited to a relatively low level so as not to cause the abnormal rising of the temperature of the heating units and the apparatus is returned from the off mode with the maximum electric energy, it is difficult to raise the temperature of the heating units in a short time due to a shortage of electric power on this occasion.

SUMMARY OF THE INVENTION

It is a general object of the present invention to provide an improved and useful heating apparatus, fixing apparatus, and image forming apparatus in which the above-mentioned problems are eliminated.

A more specific object of the present invention is to provide a heating apparatus, fixing apparatus, and image forming apparatus capable of preventing the abnormal rising of the temperature of the heating units upon repeating the feeding of a small number of pieces of paper.

Another object of the present invention is to provide a heating apparatus, fixing apparatus, and image forming apparatus capable of reducing return time upon returning from the off mode.

Yet another object of the present invention is to provide a heating apparatus, fixing apparatus, and image forming apparatus capable of preventing the abnormal rising of the temperature of the heating units upon repeating the feeding of a small number of pieces of paper even when electric energy exceeding the maximum value of electric energy charged in the standby status is charged in the auxiliary power unit.

According to one aspect of the present invention, there is provided a heating apparatus comprising: a heat generator for receiving electric power supply from a main power source and an auxiliary power unit and generating heat; a heating unit heated by the heat generator; a charging unit for charging the auxiliary power unit with electric power from the main power source; and a control unit configured to control electric power supply to the heat generator, in which a first maximum value of electric energy charged in the auxiliary power unit in a standby status is less than a second maximum value of electric energy capable of being charged in the auxiliary power unit.

According to another aspect of the present invention, in the aforementioned heating apparatus, the auxiliary power unit is charged to the second maximum value of electric energy capable of being charged in the auxiliary power unit when electric power supply to the heat generator is stopped.

According to another aspect of the present invention, in the aforementioned heating apparatus, a power source switch is not turned on when electric power supply to the heat generator is stopped.

According to another aspect of the present invention, in the aforementioned heating apparatus, when the auxiliary power unit in a standby status has not less than the first maximum value of electric energy, the auxiliary power unit is not charged until electric energy charged in the auxiliary power unit becomes less than the first maximum value.

According to another aspect of the present invention, in the aforementioned heating apparatus, when the auxiliary power unit in a standby status has not less than the first maximum value of electric energy after startup, electric energy of the auxiliary power unit is held without being discharged from the auxiliary power unit.

According to another aspect of the present invention, there is provided a fixing apparatus comprising: a heat generator for receiving electric power supply from a main power source and an auxiliary power unit and generating heat; a fixing member for fixing toner on a recording medium, the fixing member being heated by the heat generator; a charging unit for charging the auxiliary power unit with electric power from the main power source; and a control unit configured to control electric power supply to the heat generator, wherein a first maximum value of electric energy charged in the auxiliary power unit in a standby status is less than a second maximum value of electric energy capable of being charged in the auxiliary power unit.

According to another aspect of the present invention, in the aforementioned fixing apparatus, when electric power supply to the heat generator is stopped, the auxiliary power unit is charged to the second maximum value of electric energy capable of being charged in the auxiliary power unit.

According to another aspect of the present invention, in the aforementioned fixing apparatus, a power source switch is not turned on when electric power supply to the heat generator is stopped.

According to another aspect of the present invention, in the aforementioned fixing apparatus, when the auxiliary power unit in a standby status has not less than the first maximum value of electric energy, the auxiliary power unit is not charged until electric energy charged in the auxiliary power unit becomes less than the first maximum value.

According to another aspect of the present invention, in the aforementioned fixing apparatus, when the auxiliary power unit in a standby status has not less than the first maximum value of electric energy after startup, electric energy of the auxiliary power unit is held without being discharged from the auxiliary power unit.

According to another aspect of the present invention, there is provided an image forming apparatus comprising: a heating apparatus or a fixing apparatus, the heating apparatus including: a heat generator for receiving electric power supply from a main power source and an auxiliary power unit and generating heat; a heating unit heated by the heat generator; a charging unit for charging the auxiliary power unit with electric power from the main power source; and a control unit configured to control electric power supply to the heat generator, in which a first maximum value of electric energy charged in the auxiliary power unit in a standby status is less than a second maximum value of electric energy capable of being charged in the auxiliary power unit, and the fixing apparatus including: a heat generator for receiving electric power supply from a main power source and an auxiliary power unit and generating heat; a fixing member for fixing toner on a recording medium, the fixing member being heated by the heat generator; a charging unit for charging the auxiliary power unit with electric power from the main power source; and a control unit configured to control electric power supply to the heat generator, in which a first maximum value of electric energy charged in the auxiliary power unit in a standby status is less than a second maximum value of electric energy capable of being charged in the auxiliary power unit.

According to the present invention, it is possible to prevent the abnormal rising of the temperature of the heating units upon repeating the feeding of a small number of pieces of paper and to obtain improved images.

According to the present invention, it is possible to reduce return time upon returning from the off mode.

According to the present invention, it is possible prevent the abnormal rising of the temperature of the heating units upon repeating the feeding of a small number of pieces of paper.

Other objects, features and advantage of the present invention will become more apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 6:
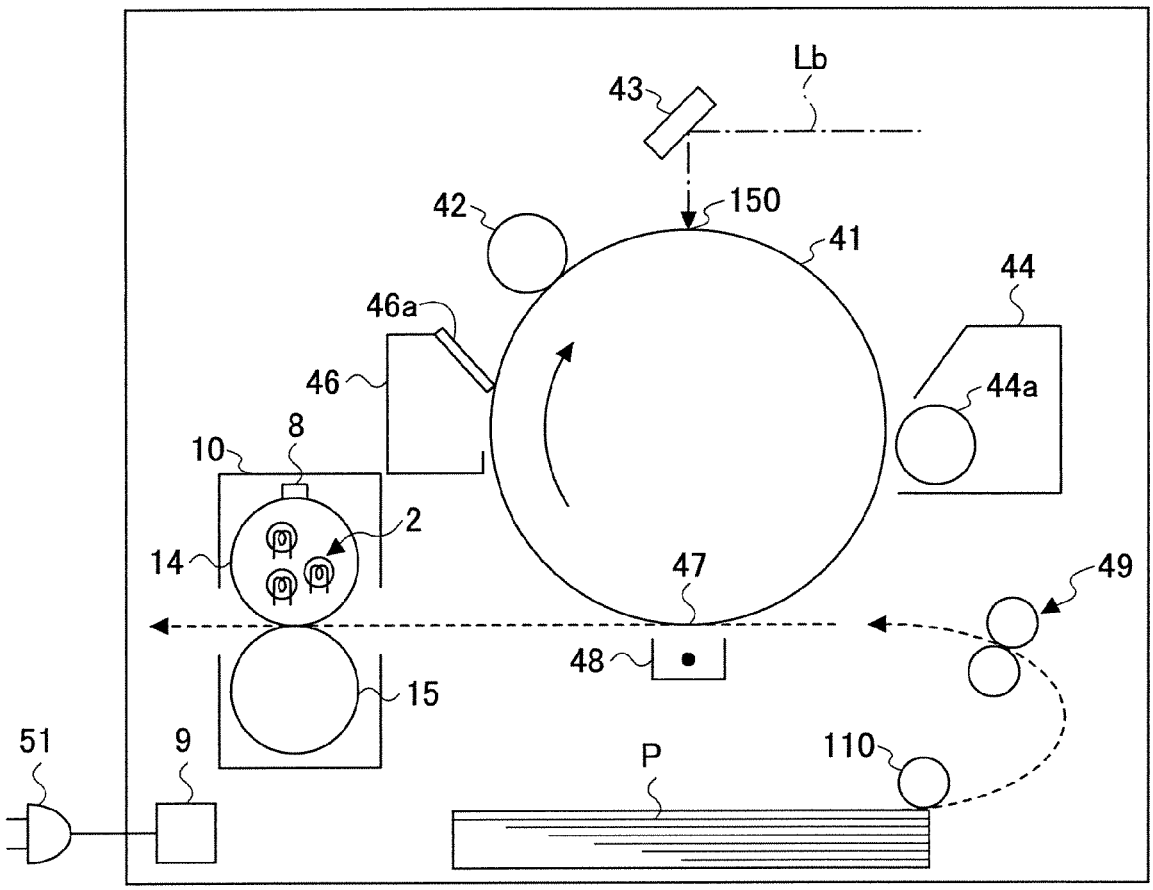
FIG. 6 is a cross-sectional view showing the first embodiment of the present invention.

FIG. 6 shows an image forming apparatus having a fixing apparatus according to a first embodiment of the present invention. In FIG. 6, numeral 41 designates a drum photoconductor as an example of an image carrier made of a rotator. On the periphery of the photoconductor 41, there are disposed an electrifying unit 42 made of an electrifying roller, a mirror 43 constituting a portion of an exposure unit, a developing unit 44 provided with a developing roller 44*a*, a transferring unit 48 for transferring a developed image to a piece of paper P used as a recording material, a cleaning unit 46 provided with a blade 46*a* in slidable contact with a circumferential surface of the photoconductor 41, and the like in order of a rotation direction indicated by an arrow in the figure. The photoconductor 41 is scanned and exposed between the electrifying unit 42 and the developing roller 44*a* by the exposure unit using an exposure light Lb via the mirror 43. A position of the photoconductor 41 where the exposure light Lb is irradiated onto is referred to as an exposure portion 150.

The transferring unit 48 is disposed so as to face a lower surface of the photoconductor 41. A portion on the photoconductor 41 facing the transferring unit 48 is referred to as a transferring portion 47. A pair of resist rollers 49 is disposed at the upstream of a transportation direction of the paper P relative to the transferring portion 47. The recording material stored in a paper feed tray not shown in the drawings is fed by a paper feed roller 110 and then transported and guided to the resist rollers 49 by a transportation guide not shown in the drawings. A fixing apparatus 10 is disposed at the downstream of the transportation direction of the paper P relative to the transferring portion 47.

Image forming in the image forming apparatus is performed as follows. The photoconductor 41 starts rotation when a driving unit not shown in the drawings drives the photoconductor 41. The photoconductor 41 is uniformly charged with electric power by the electrifying unit 42 in the dark while rotation. When the exposure portion 150 is scanned by the exposure unit using the exposure light Lb via the mirror 43, a latent image corresponding to an image to be created is formed on the photoconductor 41. The latent image on the photoconductor 41 is moved to the developing unit 44 in accordance with the rotation of the photoconductor 41 and developed by the developing unit 44, thereby forming a toner image.

On the other hand, the paper P used as a recording material on the paper feed tray is fed by the paper feed roller 110. The feeding of the paper P is suspended at a position of the resist rollers 49 through a transportation route shown in broken lines in the drawing, and sending time is waited such that the toner image on the photoconductor 41 is applied to the paper P at the transferring portion 47. Then, the resist rollers 49 are rotated so as to send the paper P at that time and the paper P is transported to the transferring portion 47. The toner image on the photoconductor 41 is applied to the paper P at the transferring portion 47 and the toner image on the photoconductor 41 is transferred to the paper P due to an electric field from the transferring unit 48.

Next, the paper P carrying the toner image transferred thereto is sent to the fixing apparatus 10. The toner image on the paper P is fixed on the paper P while passing through the fixing apparatus 10 and the paper P to which the toner image is fixed is ejected to an ejection unit not shown in the drawings.

On the other hand, residual toner left on the photoconductor 41 without being transferred is moved to the cleaning unit 46 in accordance with the rotation of the photoconductor 41 and collected while passing through the cleaning unit 46, so that the next image forming is prepared.

Figure 7:
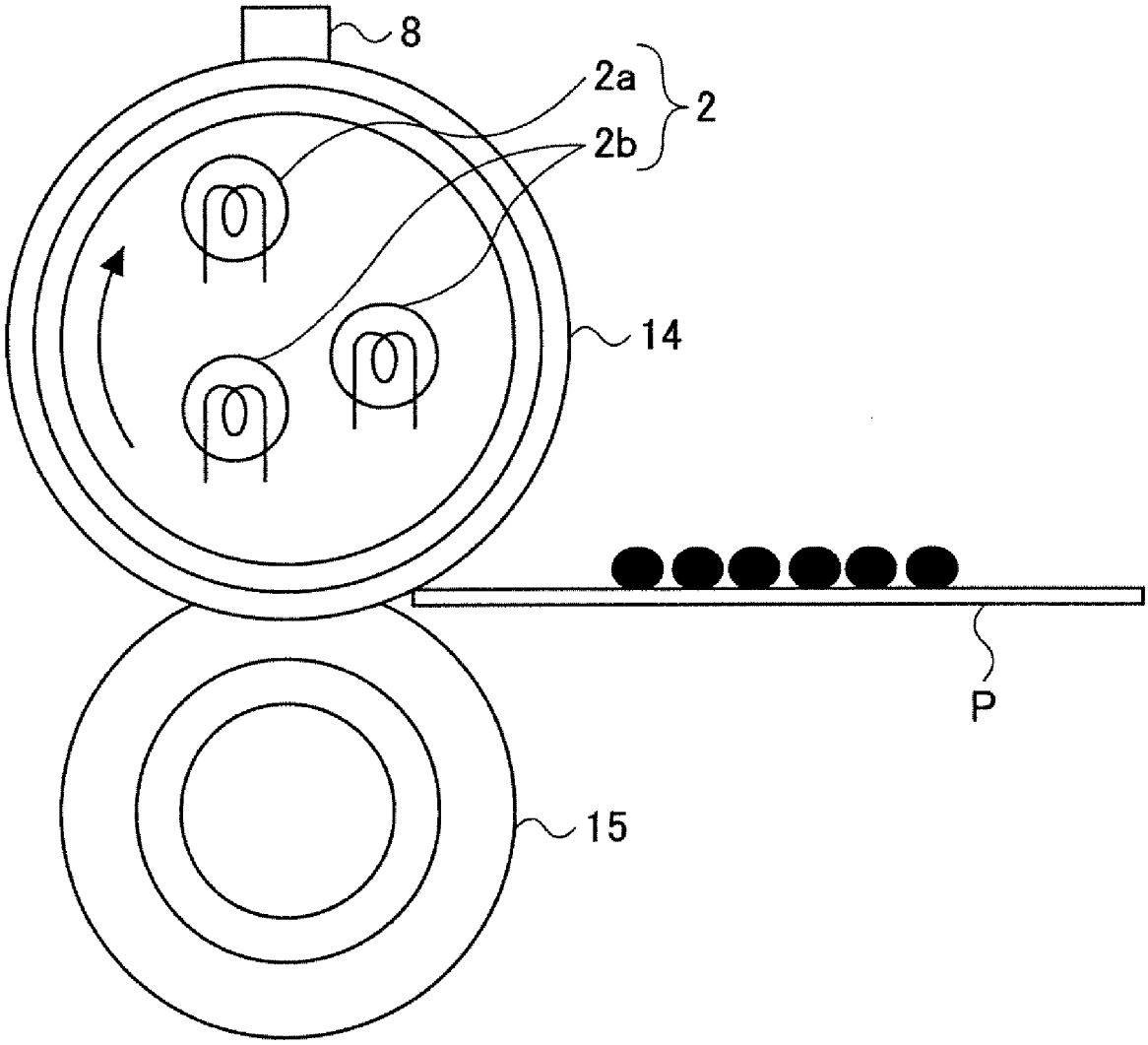
FIG. 7 is a cross-sectional view showing a fixing apparatus of the first embodiment.

As shown in FIG. 7, the fixing apparatus 10 has a fixing member 14 and a pressure member 15 as rotators each being rotatably supported by shafts (in a perpendicular direction relative to the sheet of FIG. 7) The fixing member 14 is made of a fuser roller, for example, as a heating unit and the pressure member 15 is made of a pressure roller, for example. A heat generator 2 for heating the fuser roller 14 by generating heat is disposed on the inside of the fuser roller 14 and a temperature detecting unit 8 configured to detect a surface temperature (fixing temperature) of the fixing member 14 is disposed on an external portion of the fuser roller 14.

A main power unit 9 supplies electric power from a main power source 4*a* (refer to FIG. 1) to each unit of the image forming apparatus according to the first embodiment. The main power unit 9 supplies electric power from the commercial power source 4*a* when a plug 51 of a power wire is inserted and connected to an outlet of the commercial power source 4*a*. As shown in FIG. 7, the heat generator 2 has a heat generator (main heating member) 2*a* made of an AC heater and a heat generator (auxiliary heating member) 2*b* made of a DC heater, in which a halogen heater is used, for example.

A roller base of the fuser roller 14 is preferably made of a metallic material such as aluminum, iron, or the like in terms of durability, deformation from pressure, and the like. Further, the fuser roller 14 preferably has a release layer formed on a surface thereof so as to prevent biding to toner. An inner surface of the fuser roller 14 is preferably subjected to a blackening processing for efficiently absorbing the heat of a halogen heater 2.

The pressure roller 15 includes an elastic layer made of rubber, for example, at a core thereof, so that a nip portion is formed between the pressure roller 15 and the fuser roller 14. When a recording material such as the paper P or the like where an unfixed image is formed is fed into the nip portion, the toner image is fixed on the recording material by heat and pressure. In addition, the nip portion may be formed between the pressure roller 15 and the fuser roller 14, using a foamed layer for the pressure roller 15. In this case, the heat of the fuser roller 14 is less likely to be transferred to the pressure roller 15 due to the heat insulation effect of the foamed layer, so that it is possible to raise the temperature of the fuser roller 14 in a shorter time.

Figure 1:
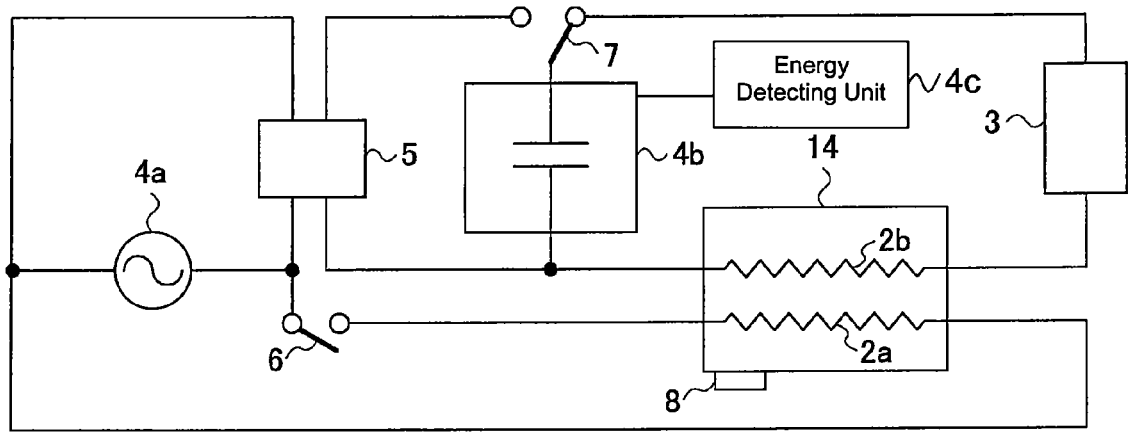
FIG. 1 is a circuit diagram showing a configuration of a circuit according to a first embodiment of the present invention.

FIG. 1 shows a circuit configuration according to the first embodiment. As shown in FIG. 1, the circuit configuration according to the first embodiment has the heat generator 2 (2*a* and 2*b*) for heating the fuser roller 14 and a charging unit 5 capable of supplying electric power from the commercial power source 4*a* to an auxiliary power unit 4*b*. The charging unit 5 performs voltage regulation and AC-DC conversion for electric power from the commercial power source 4*a*, supplies DC electric power to the auxiliary power unit 4*b* after the AC-DC conversion, and charges the auxiliary power unit 4*b*. Further, a main power source switch 6 is controlled by a first control unit as a control unit configured to control electric connection to the heat generator 2*a*. The first control unit is supplied with electric power from the main power unit 9 regardless of whether the power source switch of the image forming apparatus is turned on or off. And the first control unit controls the main power source switch 6 such that the surface temperature of the fuser roller 14 is set to the temperature for enabling fixing, based on a mode signal from a main control unit for controlling each unit of the image forming apparatus, a temperature detection signal from the temperature detecting unit 8, and the like.

A second control unit 3 is supplied with electric power from the main power unit 9 regardless of whether the power source switch of the image forming apparatus is turned on or off. The second control unit 3 controls electric connection from the auxiliary power unit 4*b* to the heat generator 2*b*, based on the mode signal from the main control unit, the temperature detection signal from the temperature detecting unit 8, an output value of an electric energy detecting unit 4*c* configured to detect electric energy (voltage) of the auxiliary power unit 4*b*, and the like. A charging/discharging switching unit 7 switches connection of the auxiliary power unit 4*b* between the charging unit 5 and heat generator 2*b*, based on the mode signal from the main control unit, the temperature detection signal from the temperature detecting unit 8, the output value from the electric energy detecting unit, and the like. When the charging/discharging switching unit 7 connects the auxiliary power unit 4*b* to the charging unit 5, the voltage of electric power from the commercial power source 4*a* is regulated, the electric power is converted from AC to DC, and then the converted electric power is supplied to the auxiliary power unit 4*b*, thereby charging the auxiliary power unit 4*b*.

When the charging/discharging switching unit 7 connects the auxiliary power unit 4*b* to the heat generator 2*b*, electric power is supplied from the auxiliary power unit 4*b* to the heat generator 2*b* via the second control unit 3. When the main power source switch 6 is turned on, electric power is supplied from the commercial power source 4*a* to the heat generator 2*a*. Examples of the auxiliary power unit 4*b* include an electric double layer capacitor capable of charging and discharging.

Figure 2:
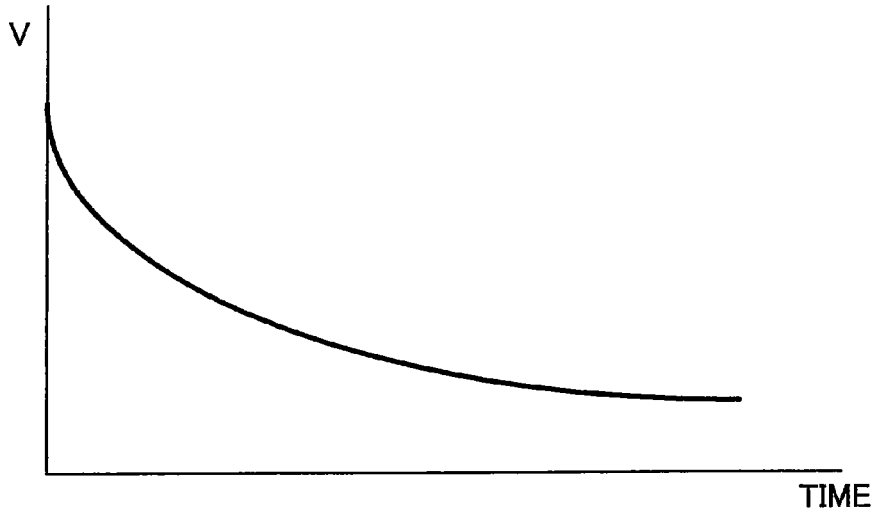
FIG. 2 is a characteristic diagram showing discharging characteristics when an electric double layer capacitor is connected to a heat generator.

FIG. 2 shows discharging characteristics when the electric double layer capacitor is connected to the heat generator 2*b*. A longitudinal axis in FIG. 2 indicates the voltage of the electric double layer capacitor and a lateral axis in FIG. 2 indicates time. The electric double layer capacitor has high voltage at the beginning of discharge and the voltage is reduced in accordance with the passage of discharging time due to the characteristics thereof. In other words, the electric double layer capacitor is capable of supplying large electric power at the beginning of discharge and the electric power supply is reduced at the end of discharge. In the first embodiment, in the return status where the temperature of the fuser roller 14 is returned to the temperature for enabling fixing from starting up or the off mode, the temperature of the heating unit 14 is raised in a short time in accordance with the characteristics of the electric double layer capacitor at the beginning of discharge. In the paper-feed status, the temperature of the heating unit 14 is raised by the heat generator 2*a* supplied with electric power from the commercial power source 4*a* along with the heat generator 2*b* (supplied with electric power from the auxiliary power unit 4*b*) so as to maintain the temperature of the heating unit 14. In this case, examples of the heating unit 14 include a fuser belt besides a fuser roller. In addition, examples of the heat generators 2*a* and 2*b* include a halogen heater.

Figure 3A:
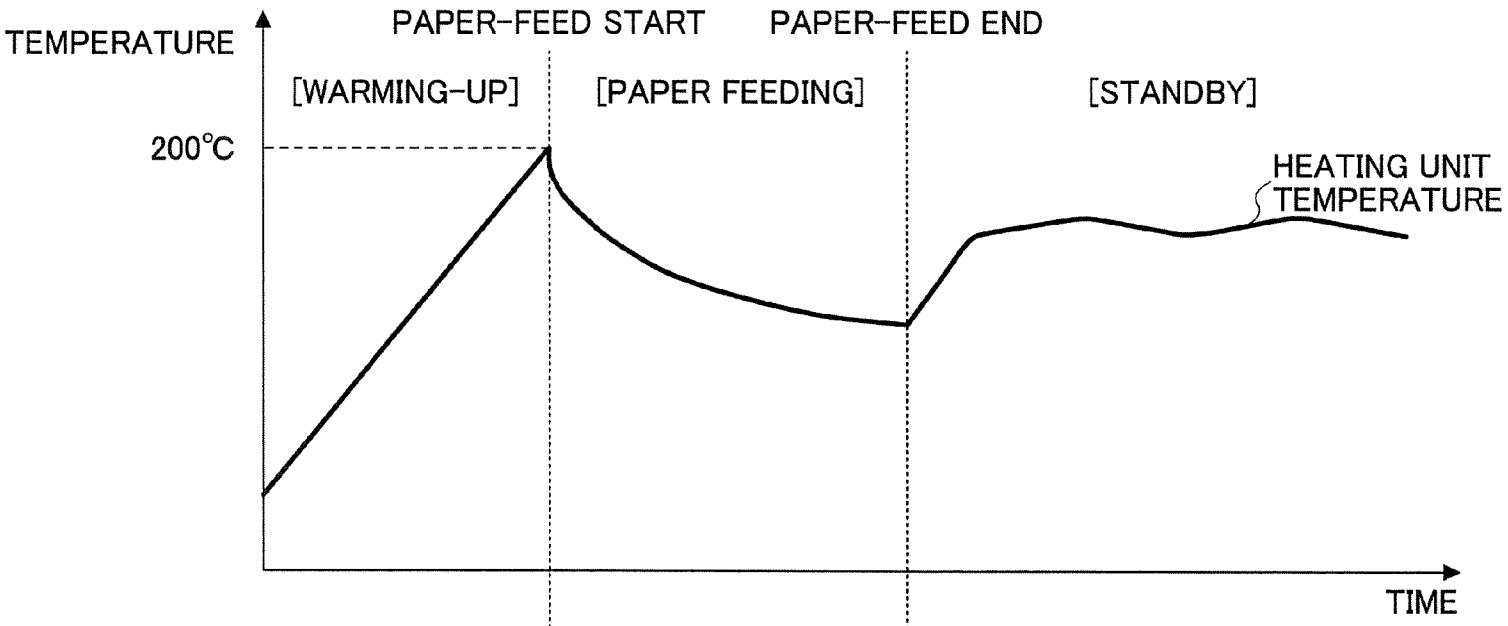
FIG. 3 is a waveform diagram showing a temperature of a heating unit and electric energy in an auxiliary power unit in the first embodiment.
Figure 3B:
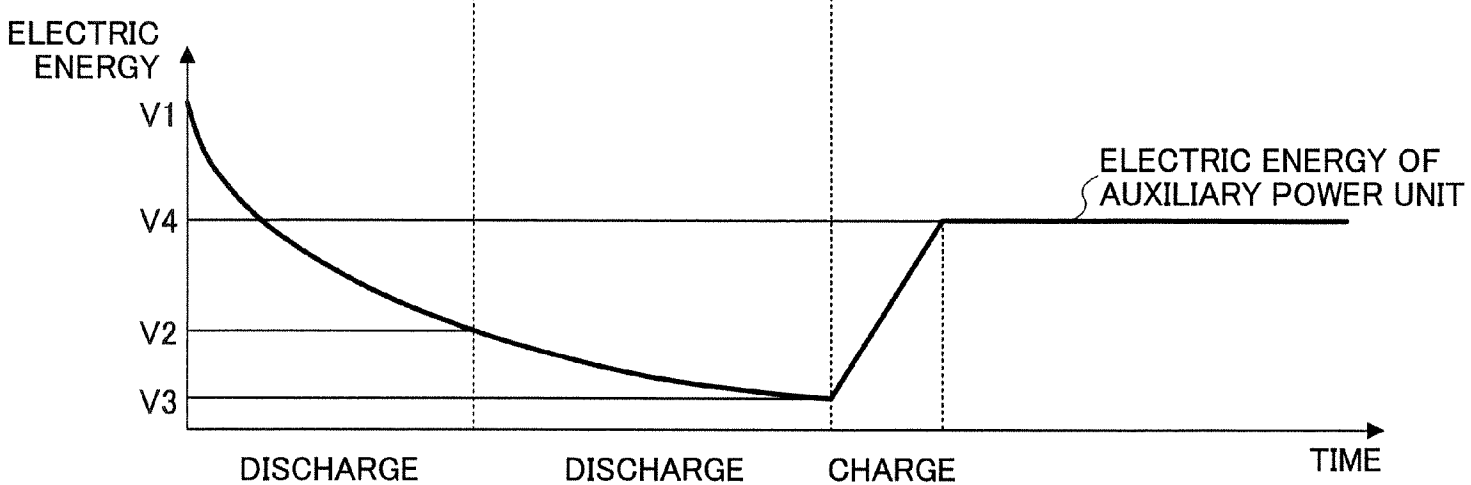

FIG. 3 is a waveform diagram showing the temperature of the heating unit 14 and electric energy in the auxiliary power unit 4*b* according to the first embodiment.

In a warming-up status immediately after the power source switch of the image forming apparatus is turned on, the charging/discharging switching unit 7 connects the auxiliary power unit 4*b* to the heat generator 2*b* and electric power is supplied from the auxiliary power unit 4*b* to the heat generator 2*b*. In accordance with this, the electric energy (voltage) of the auxiliary power unit 4*b* is reduced from the maximum value V1 (full charge value) of electric energy that can be charged in the auxiliary power unit 4*b* to the value V2. Thereafter, the electric energy of the auxiliary power unit 4*b* at the beginning of paper feeding is the value V2. In this case, the heat generator 2*a* is supplied with electric power from the commercial power source 4*a* via the main power source switch 6, and the temperature of the heating unit 14 reaches the temperature for enabling fixing, namely, 200° C., for example.

In the following paper-feed status, the heat of the heating unit 14 is transmitted to the paper P and the temperature of the heating unit 14 is reduced. The electric energy of the auxiliary power unit 4*b* is reduced from the value V2 to the value V3 as a result of consumption in the heat generator 2*b*. In the standby status following the end of the paper feeding, the charging/discharging switching unit 7 connects the auxiliary power unit 4*b* to the charging unit 5, causes the charging unit 5 to charge the auxiliary power unit 4*b* from the value V3 to the value V4, and then connects the auxiliary power unit 4*b* to the heat generator 2*b* in order to supply electric energy consumed in the heat generator 2*b*, based on the mode signal from the main control unit, the temperature detection signal from the temperature detecting unit 8, the output value from the electric energy detecting unit, and the like. The second control unit 3 is turned off in the standby status and the electric power supply from the auxiliary power unit 4*b* to the heat generator 2*b* is stopped. Thus, the value V4 indicates the maximum value of electric energy that can be charged in the auxiliary power unit 4*b* in the standby status.

When an image forming job is performed after the standby status, if paper feeding is repeated, using three pieces of paper at one time or using five pieces of paper at one time, for example, electric power is excessively supplied from the auxiliary power unit 4*b* to the heat generator 2*b* when the electric power of the auxiliary power unit 4*b* is the value V1 at the beginning of the image forming job. Thus, in the first embodiment, the maximum value of the electric power charged in the auxiliary power unit 4*b* is the value V4 in the standby status.

In FIG. 3, although the value V2 is less than the value V4, the values are not limited to this, so that the value V2 may be equal to the value V4 or more than the value V4. The sizes of the value V2 and the value V4 are different in accordance with a relationship of required electric power between the warming-up (return) status and the paper-feed status and the capacity or specifications of the auxiliary power unit 4*b*. However, the paper-feeding immediately after the warming-up is performed in the most severe conditions (conditions that most require electric power supply from the auxiliary power unit 4*b*) with respect to the reduction of the temperature of the heating unit 2. Thus, it is most preferable to use the auxiliary power unit 4*b* with capacity in which V2≧V4. In addition, in the first embodiment, the heating unit 14, the heat generator 2 and the circuit shown in FIG. 1 constitute a heating apparatus for heating the paper P. It is possible to apply the present invention to a heating apparatus for heating recording paper carrying an image so as to modify surface properties thereof. It is also possible to apply the present invention to a heating apparatus for performing a drying process on a sheet-like form or a laminating process.

In the first embodiment, the maximum value V4 of electric energy charged in the auxiliary power unit 4*b* in the standby status is less than the maximum value V1 of electric energy that can be charged in the auxiliary power unit 4*b*. Thus, it is possible to avoid supplying excessive electric power from the auxiliary power unit 4*b* to the heat generator 2 in the paper feeding and to prevent the abnormal rising of the temperature of the heating unit upon repeating the feeding of a small number of pieces of paper, thereby obtaining improved images.

Figure 4A:
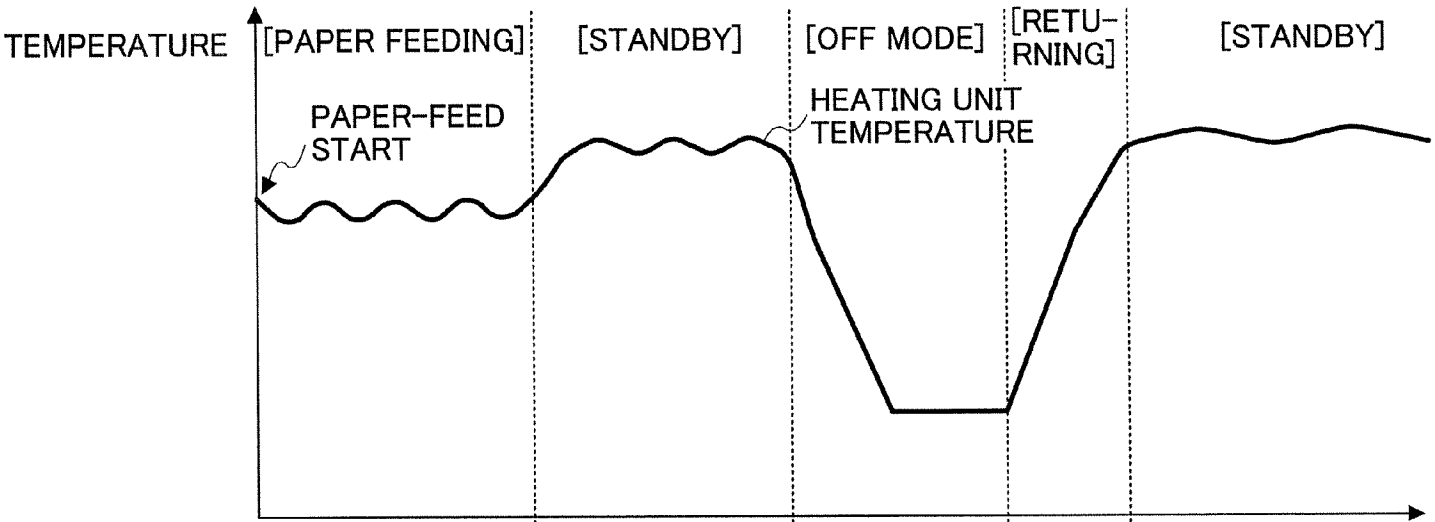
FIG. 4 is a waveform diagram showing a temperature of a heating unit and electric energy in an auxiliary power unit in a second embodiment of the present invention.
Figure 4B:
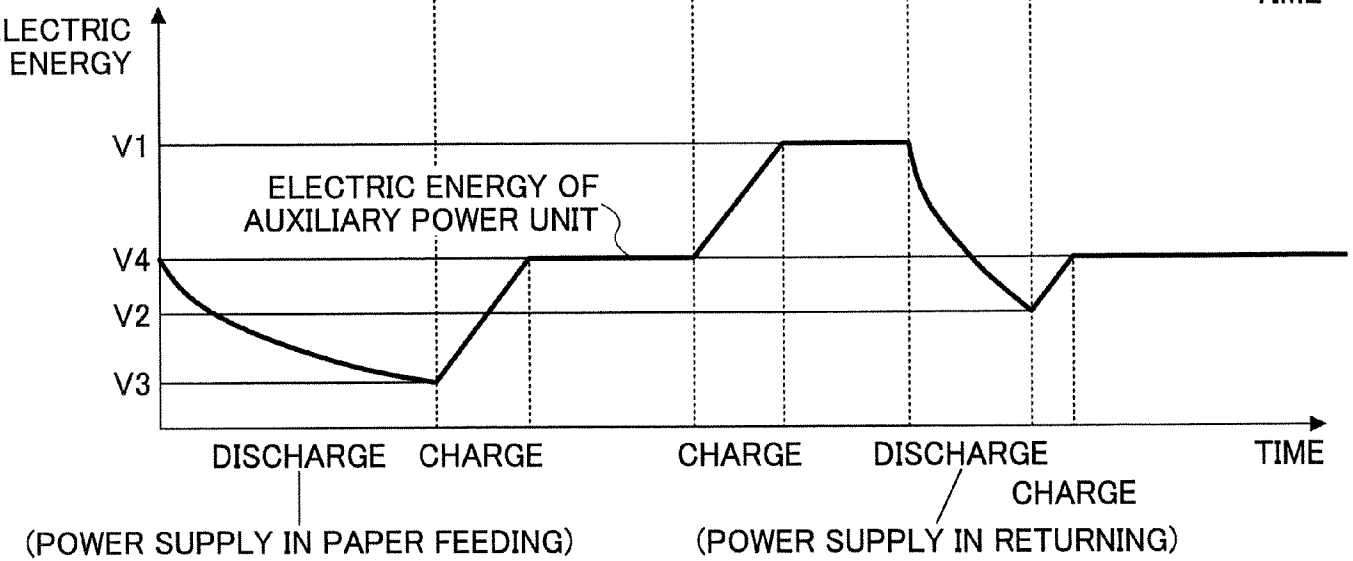

FIG. 4 is a waveform diagram showing the temperature of the heating unit 14 and the electric energy in the auxiliary power unit 4*b* in a second embodiment of the present invention. In the second embodiment, the auxiliary power unit 4*b* is charged to the value V4 in the standby status and then the apparatus shifts to the off mode. At the same time, the charging/discharging switching unit 7 in the off mode connects the auxiliary power unit 4*b* to the charging unit 5, causes the charging unit 5 to charge the auxiliary power unit 4*b* to the value V1, and then connects the auxiliary power unit 4*b* to the heat generator 2*b*, based on the mode signal from the main control unit, the temperature detection signal from the temperature detecting unit 8, the output value from the electric energy detecting unit, and the like.

The second control unit 3 is turned off in the off mode and electric power supply from the auxiliary power unit 4*b* to the heat generator 2*b* is stopped. Accordingly, the auxiliary power unit 4*b* is charged to the value V1 in the off mode so as to prepare for the next return status. In this case, the value V1 is the maximum value of electric energy that can be charged in the auxiliary power unit 4*b*. Also, the value V1 is the volume of charge required for the auxiliary power unit 4*b* so as to raise the temperature of the heating unit 2 in a short time. Next, the charging/discharging switching unit 7, in the return status for returning from the off mode to the temperature for enabling the heating unit 14 to perform fixing, connects the auxiliary power unit 4*b* to the heat generator 2*b* so as to raise the temperature of the heat generator 2 from the beginning of the returning from the off mode to the temperature for enabling the heating unit 14 to perform fixing, based on the mode signal from the main control unit, the temperature detection signal from the temperature detecting unit 8, the output value from the electric energy detecting unit, and the like. In accordance with this, electric power is supplied from the auxiliary power unit 4*b* to the heat generator 2*b* and electric power is supplied from the commercial power source 4*a* to the heat generator 2*a* via the main power source switch 6 at the same time, so that the temperature of the heating unit 14 is raised to the temperature for enabling fixing. In this case, the electric energy of the auxiliary power unit 4*b* is reduced to the value V2 as a result of discharging electricity to the heat generator 2*b*.

Then, following the shift to the standby status, the charging/discharging switching unit 7 connects the auxiliary power unit 4*b* to the charging unit 5, causes the charging unit 5 to charge the auxiliary power unit 4*b* to the value V4, and then connects the auxiliary power unit 4*b* to the heat generator 2*b*, based on the mode signal from the main control unit, the temperature detection signal from the temperature detecting unit 8, the output value from the electric energy detecting unit, and the like. The second control unit 3 is turned off in the standby status and the electric power supply from the auxiliary power unit 4*b* to the heat generator 2*b* is stopped. Thus, the auxiliary power unit 4*b* is charged to the electric energy V4 set for the standby status and is prepared for the paper-feed status.

It is difficult to raise the temperature of the heating unit 14 in a short time due to a lack of electric energy when saving the maximum electric energy charged in the auxiliary power unit 4*b* in the standby status so as not to cause the abnormal rising of the temperature of the heating unit upon repeating the feeding of a small number of pieces of paper and then trying to return from the off mode to the temperature for enabling the heating unit 14 to perform fixing without changing the maximum electric energy. In view of this, according to the second embodiment, when the electric power supply to the heat generator 2 is stopped (the off-mode), the auxiliary power unit 4*b* is charged to the maximum value V1 of electric energy that can be charged, so that it is possible to reduce return time when returning to the temperature for enabling the heating unit 14 to perform fixing.

Figure 5A:
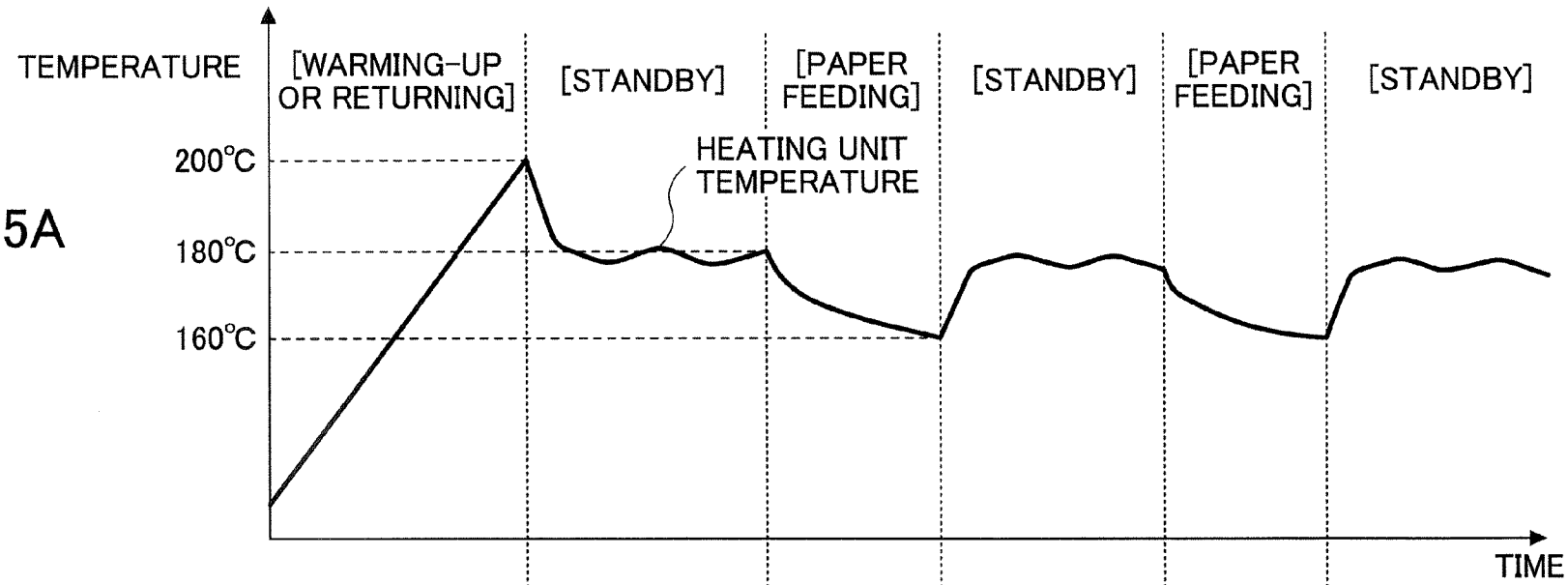
FIG. 5 is a waveform diagram showing a temperature of a heating unit and electric energy in an auxiliary power unit in a third embodiment of the present invention.
Figure 5B:
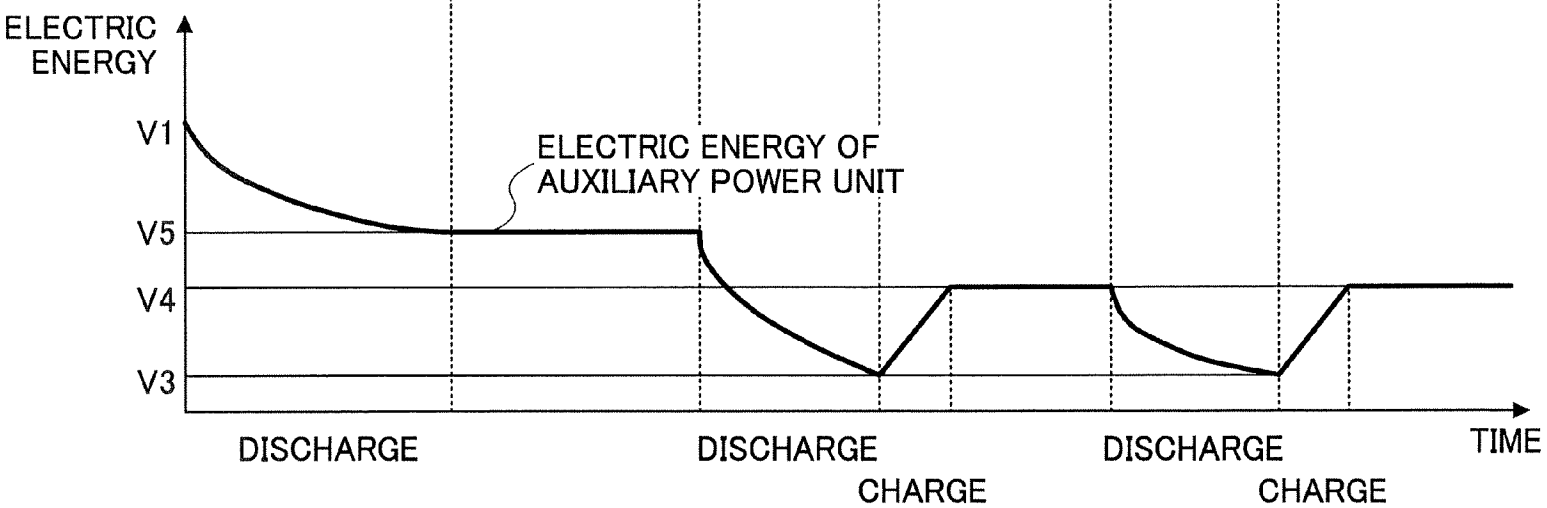

FIG. 5 is a waveform diagram showing the temperature of the heating unit 14 and the electric energy in the auxiliary power unit 4*b* in a third embodiment of the present invention. In the third embodiment, when electric energy discharged from the auxiliary power unit 4*b* is small and electric energy V5 not less than electric energy V4 necessary for paper feeding is charged in the auxiliary power unit 4*b* as a result, because of the paper feeding not being performed immediately after the warming-up in the second embodiment, peripheral environment in the third embodiment, input voltage from the commercial power source 4*a* being high, and the like, the charging/discharging switching unit 7 in the standby status does not connect the auxiliary power unit 4*b* to the charging unit 5 so as not to charge the auxiliary power unit 4*b* to the value V1, based on the mode signal from the main control unit, the temperature detection signal from the temperature detecting unit 8, the output value from the electric energy detecting unit, and the like. Also, the second control unit 3 in the standby status does not intentionally discharge electricity from the auxiliary power unit 4*b* to the heat generator 2*b*, based on the mode signal from the main control unit, the temperature detection signal from the temperature detecting unit 8, the output value from the electric energy detecting unit, and the like. This is because if the auxiliary power unit 4*b* is charged to the value V1, the abnormal rising of the temperature of the heating unit is caused by repeating the feeding of a small number of pieces of paper as mentioned above and the intentional discharge of the auxiliary power unit 4*b* to the value V4 does not contribute to power saving.

Accordingly, as shown in FIG. 5, the auxiliary power unit 4*b* stands by while maintaining the value V5 without discharging electricity even when the value of electric energy is not less than the value V4 in the standby status, and charge volume for recovering the volume of electric power consumed in the first paper feeding is the value V4. In other words, the charging/discharging switching unit 7 in the standby status after the first paper feeding connects the auxiliary power unit 4*b* to the charging unit 5, causes the charging unit 5 to charge the auxiliary power unit 4*b* to the value V4, and then connects the auxiliary power unit 4*b* to the heat generator 2*b*, based on the mode signal from the main control unit, the temperature detection signal from the temperature detecting unit 8, the output value from the electric energy detecting unit, and the like. The second control unit 3 is turned off in the standby status and the electric power supply from the auxiliary power unit 4*b* to the heat generator 2*b* is stopped. Thus, the auxiliary power unit 4*b* is charged to the electric energy V4 set for the standby status and is prepared for the paper-feed status. Thereafter, the maximum value of electric power for the auxiliary power unit 4*b* in the standby status is always the value V4 after the paper feeding. When the apparatus shifts to the off mode without an image forming job operation after the standby status, it is preferable to raise the maximum value of the electric energy for the auxiliary power unit 4*b* to the value V1 as mentioned above in order to raise the temperature of the heat generator 2 in the next return status where the heating unit 14 returns to the temperature for enabling fixing.

In the third embodiment, the temperature of the heat generator 2 is controlled to be a set temperature or the set temperature ±10° C. by the control of main power source switch 6 of the first control unit, namely, 180° C., for example. In the warming-up status or the return status for returning from the off mode to the temperature for enabling the heating unit 14 to perform fixing, the temperature of the heat generator 2 is raised to 200° C., for example. When the temperature is lowered in the paper-feed status, the temperature is maintained to be a lower limit temperature for enabling fixing, namely, not less than 160° C., for example.

According to the third embodiment, when electric energy V5 not less than the electric energy V4 is charged in the auxiliary power unit 4*b*, the electric energy V4 being the first maximum value of electric energy charged in the auxiliary power unit 4*b* in the standby status, the charging of the auxiliary power unit 4*b* is not performed until the level of electric energy charged in the auxiliary power unit 4*b* becomes less than the first maximum value, so that it is possible to prevent the abnormal rising of the temperature of the heating unit upon repeating the feeding of a small number of pieces of paper.

Figure 8:
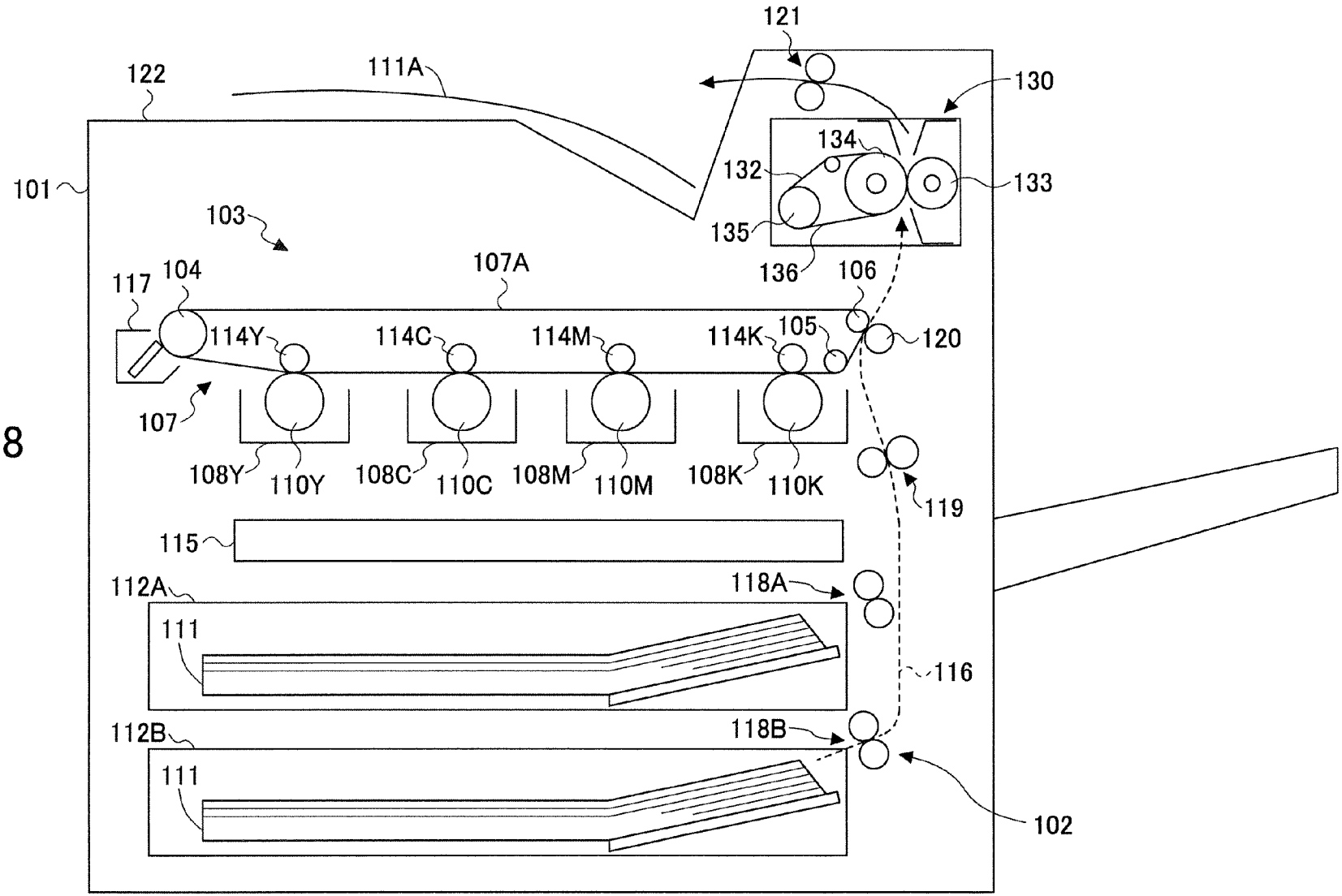
FIG. 8 is a cross-sectional view showing a forth embodiment of the present invention.

FIG. 8 shows a forth embodiment of the present invention. An image forming apparatus in the fourth embodiment concerns a color printer (hereafter referred to as a printer) capable of forming full-color images. The present invention is not limited to printers, but can be applied to image forming apparatuses such as copying machines, facsimiles, and complex machines thereof. The printer according to the fourth embodiment includes a paper feed unit 102 provided with plural paper feed trays 112A and 112B in which paper 111 is stored as a recording material on a lower portion of an image forming apparatus body 101, and an image forming unit 103 above the paper feed unit 102. The image forming unit 103 includes image creating units 108Y, 108C, 108M, and 108K having photoconductor drums 110Y, 110C, 110M, and 110K as image carriers, an intermediate transfer unit 107 having an intermediate transfer belt 107A as an intermediate transfer body with flexibility wrapped and placed on plural rollers 104, 105, and 106, a drawing unit 115 for performing an optical drawing on each of the photoconductor drums 110Y, 110C, 110M, and 110K, and a fixing apparatus 130 for fixing an unfixed toner image on the paper 111. A transportation route 116 provided with a transportation roller for transporting the paper 111 is formed from the paper feed unit 102 to the fixing apparatus 130.

The image creating units 108Y, 108C, 108M, and 108K having the photoconductor drums 110Y, 110C, 110M, and 110K include electrifying units, developing units, and cleaning units not shown in the drawings. Each of the electrifying units, developing units, and cleaning units is disposed on peripheral portions of the photoconductor drums and is detachable from the image forming apparatus body 101. The image creating units 108Y, 108C, 108M, and 108K include developing units in which yellow, cyan, magenta, and black toners are stored.

The intermediate transfer belt 107A faces each of the photoconductor drums 110Y, 110C, 110M, and 110K and is rotated in the counterclockwise direction in FIG. 8 when any one of the plural rollers 104, 105, and 106 is driven by a driving motor not shown in the drawings. An inner portion of the intermediate transfer belt 107A facing each of the photoconductor drums 110Y, 110C, 110M, and 110K includes transfer rollers 114Y, 114C, 114M, and 114K as a primary transfer unit. A transfer bias for primary transfer is applied from the power unit to the transfer rollers 114Y, 114C, 114M, and 114K. A belt cleaning unit 117 for cleaning a surface of the intermediate transfer belt 107A is disposed on a portion facing the roller 104. These intermediate transfer belt 107A, the plural rollers 104, 105, and 106 on which the intermediate transfer belt 107A is wrapped and placed, the transfer rollers 114Y, 114C, 114M, and 114K, and the belt cleaning unit 117 are constructed as an integrated unit and detachable from the image forming apparatus body 101.

A transfer roller 120 to which a secondary bias is applied from the power source touches the intermediate transfer belt 107A at a portion facing the roller 106. The transfer roller 120 and a portion of the intermediate transfer belt 107A are disposed so as to face the transportation route 116.

The drawing unit 115 irradiates a modulated laser beam onto surfaces of the photoconductor drums 110Y, 110C, 110M, and 110K and forms latent images in each color on the surfaces of the photoconductor drums 110Y, 110C, 110M, and 110K. In the fourth embodiment, the drawing unit 115 is disposed below the image creating units 108Y, 108C, 108M, and 108K and irradiates the laser beam from the lower portion of the unit to the upper portion of the unit.

When an image forming operation is started, the photoconductor drums 110Y, 110C, 110M, and 110K of the image creating units 108Y, 108C, 108M, and 108K are rotated in the clockwise direction by the driving unit not shown in the drawings and the surfaces of the photoconductor drums 110Y, 110C, 110M, and 110K are uniformly electrified by each of the electrifying units to have a predetermined polarity. An electrostatic latent image is formed on the electrified surfaces of the photoconductor drums 110Y, 110C, 110M, and 110K when a laser beam is irradiated thereon from the drawing unit 115. In this case, plural sets of image information for modulating each laser beam irradiated onto the photoconductor drums 110Y, 110C, 110M, and 110K are plural sets of monochromatic image information in which a desired full-color image is resolved into yellow, cyan, magenta, and black color information. The thus-formed electrostatic latent image is developed by the developing units when passing through spaces between the photoconductor drums 110Y, 110C, 110M, and 110K and each developing unit thereof and visualized as a toner image.

The intermediate transfer belt 107A is moved in the counterclockwise direction by the driving unit not shown in the drawings. A yellow toner image formed on the photoconductor drum 110Y in the image creating unit 108Y is transferred to the intermediate transfer belt 107A by the transfer roller 114Y, the image creating unit 108Y being positioned at the uppermost stream of the movement direction of the intermediate transfer belt 107A and provided with the developing unit having the yellow toner. In the intermediate transfer belt 107A, a cyan toner image, a magenta toner image, and a black toner image formed on the photoconductor drums 110C, 110M, and 110K in the image creating units 108C, 108M, and 108K are sequentially transferred on the yellow toner image by the transfer rollers 114C, 114M, and 114K. As a result, a full-color toner image is formed and the intermediate transfer belt 107A carries the image.

Residual toner adhered to the surfaces of the photoconductor drums 110Y, 110C, 110M, and 110K after the toner images are transferred is removed therefrom by the cleaning unit, and then the photoconductor drums 110Y, 110C, 110M, and 110K are subjected to a process for removing electricity by an electricity-removing unit not shown in the drawings, so that electric potential of the surfaces is initialized and the photoconductor drums are prepared for the next image formation.

On the other hand, the paper 111 is fed from the paper feed unit 102 and sent to the transportation route 116 when a paper feed roller 118A or 118B is driven and rotated. The paper 111 sent to the transportation route 116 is held until paper feed time by a pair of resist rollers 119 disposed on a paper feed side of the transportation route 116 relative to the secondary transfer roller 120 and the paper 111 is fed to the portion where the roller 106 and the transfer roller 120 are disposed in an opposing manner. At this time, transfer voltage having a reverse polarity to the polarity of the toner images on the surface of the intermediate transfer belt 107A is applied to the transfer roller 120 from the power source, so that the toner images on the surface of the intermediate transfer belt 107A is collectively transferred to the paper 111.

The paper 111 to which the toner images are transferred is transported to the fixing apparatus 130. When the paper 111 passes through the fixing apparatus 130, heat and pressure are applied thereto, so that an unfixed toner image T is fused and then fixed on the paper 111. The paper 111 on which the toner image is fixed is transported to an ejection unit 121 positioned at an end of the transportation route 116 and ejected to an ejection tray 122 disposed on an upper portion of the image forming apparatus body 101 as a paper ejection unit. Residual toner on the intermediate transfer belt 107A after the toner images are transferred to the paper 111 is removed by the belt cleaning unit 117.

Next, the fixing apparatus 130 will be described.

The fixing apparatus 130 includes a fixing rotator 132 as a fixing member, a pressure rotator 133 for contacting the fixing rotator 132 while applying pressure thereto as a pressure member. The paper 111 to which the unfixed toner image T is transferred is caused to pass through a nip portion formed with the fixing rotator 132 and the pressure rotator 133, whereby the unfixed toner image T is fixed on the paper 111. The fixing apparatus 130 is constructed detachably from the image forming apparatus body 101.

Figure 9:
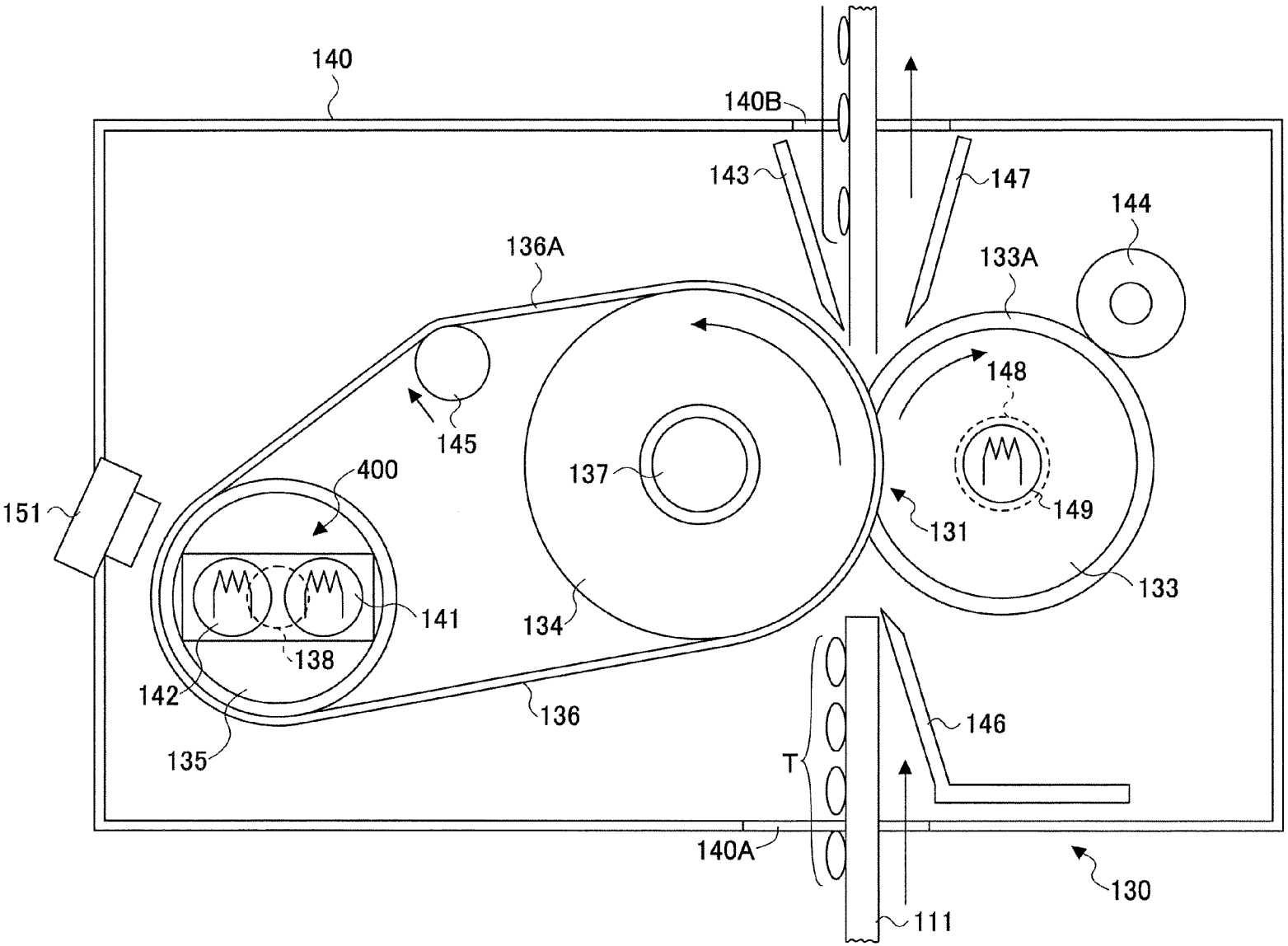
FIG. 9 is a cross-sectional view showing a fixing apparatus of the fourth embodiment.

As shown in FIG. 9, the fixing rotator 132 includes a rotator disposed on an imaging side of the paper 111 upon single-side printing and the pressure rotator 133 includes a rotator disposed on a non-imaging side of the paper 111 upon single-side printing.

In the fourth embodiment, the fixing rotator 132 includes a fuser roller 134, a heating roller 135, and a fuser belt 136 wrapped and placed therebetween as plural rotators, the fuser belt 136 having heat resistance and an endless shape. The fuser roller 134 and the heating roller 135 are rotatably supported by shafts 137 and 138 such that rotation centers thereof are fixed and a pitch between the axes is constant in a casing 140 used as a body of the fixing apparatus 130.

The fuser roller 134 is disposed on the transportation route 116 and a surface 136A of the fuser belt 136 wrapped and placed on a circumferential surface of the fuser roller 134 is positioned so as to face the transportation route 116. The fuser roller 134 includes an elastic body such as rubber. The heating roller 135 includes a hollow metallic roller in which plural heaters (two heaters in the fourth embodiment) 141 and 142 constituting a heating source 400 are disposed. Although examples of the plural heaters 141 and 142 include halogen heaters and infrared heaters, other heaters may be used.

On an inner side of the fuser belt 136 positioned between the fuser roller 134 and the heating roller 135, a tension roller 145 is disposed as a belt-stretching member applied pressure from the inner side of the fuser belt 136 to an outer side thereof, the pressure being applied by a pressure unit such as a spring, for example, which is not shown in the drawings. The tension roller 145 provides appropriate tension to the fuser belt 136 wrapped and placed on the fuser roller 134 and the heating roller 135.

The pressure rotator 133 is constructed as a pressure roller for pressing the fuser roller 134 via the fuser belt 136 held therebetween. The pressure rotator 133 includes a hollow roller in which a heater 149 is disposed as a heating unit in the fourth embodiment and the pressure rotator 133 functions as a heating roller. The pressure rotator 133 is rotatably supported by a shaft 148 thereof relative to the casing 140 and is constructed so as to be relatively displaced relative to the fuser roller 134. In other words, the pressure rotator 133 is movably supported by the shaft 148 in the right and left directions in FIG. 8 such that the pressure rotator 133 is brought close to or separated from the fuser roller 134 upon thermal expansion or a change of the thickness of the paper 111. In addition, the pressure rotator 133 is constructed so as to contact a circumferential surface 134A of the fuser roller 134 while applying pressure thereto using a biasing unit, such as a spring not shown in the drawings, via the fuser belt 136.

In the vicinity of the fixing rotator 132, a non-contact temperature sensor 151 for detecting a temperature of the fuser belt 136 in a non-contact manner is disposed as a temperature detecting unit. The non-contact temperature sensor 151 is disposed on a position for detecting a surface temperature of the fuser belt 136 wrapped and placed on the heating roller 135. Although a thermister is used for the non-contact temperature sensor 151, other sensor capable of detecting the temperature in a non-contact manner may be used.

In the vicinity of the fuser belt 136 wrapped and placed on the fuser roller 134, a separation member 143 is disposed separately from the surface 136A of the fuser belt 136, the separation member 143 separating paper 111, on which a toner image T1 is fixed while passing through a nip portion 131, from the surface 136A of the fuser belt 136. Although the separation member 143 is constructed as a plate-like member extending in the axis direction of the fuser roller 134, the separation member 143 may be formed in a comb-like shape.

In the vicinity of the pressure rotator 133, a cleaning member 144 for touching a circumferential surface 133A of the pressure rotator 133 is disposed, the cleaning member 144 removing paper powder and toner adhered to the circumferential surface 133A. The cleaning member 144 includes a roller member extending in the axis direction of the pressure rotator 133.

Paper guiding members 146 and 147 are disposed on a pressure rotator 133 side of the casing 140 at the upstream and the downstream of a paper transportation direction relative to the nip portion 131. The paper guiding member 146 is disposed in the vicinity of an inlet 140A formed on the casing 140 and guides the paper 111 to which the unfixed toner image T is transferred to the nip portion 131. The paper guiding member 147 is disposed in the vicinity of an outlet 140B formed on the casing 140 such that transportation route 116 is positioned between the separation member 143 and the paper guiding member 147 and the distance therebetween is increased toward ends thereof. The fixing apparatus 130 is installed on the image forming apparatus body 101 such that the inlet 140A and the outlet 140B are positioned on the transportation route 116. The casing 140 includes at least the fixing rotator 132, pressure rotator 133, separation member 143, and cleaning member 144.

The fuser roller 134, heating roller 135, fuser belt 136, heaters 141 and 142, and temperature detecting unit 151 constitute a heating unit for heating the paper 111. The heaters 141 and 142 are supplied with electric power from the commercial power source 4a and the auxiliary power unit 4*b* using the circuit shown in FIG. 1 in the same manner as in the heat generators 2*a* and 2*b* of the third embodiment.

According to the fourth embodiment, the same effects as in the third embodiment are obtained.

The present invention is not limited to the specifically disclosed embodiment, and variations and modifications may be made without departing from the scope of the present invention.

The present application is based on Japanese priority application No. 2005-221626 filed Jul. 29, 2005, the entire contents of which are hereby incorporated herein by reference.

What is claimed is:

1. A heating apparatus comprising:

a heat generator for receiving electric power supply from a main power source and an auxiliary power unit and generating heat;

a heating unit heated by the heat generator;

a charging unit for charging the auxiliary power unit with electric power from the main power source, the charging unit being stopped in response to determining that electric energy charged in the auxiliary power unit has reached a first predetermined threshold value when in a standby status; and a control unit configured to control electric power supply to the heat generator, wherein the charging unit is stopped in response to determining that the electric energy charged in the auxiliary power unit has reached a second predetermined threshold value which is greater than the first predetermined threshold value, when in another status.

2. The heating apparatus according to claim 1, wherein the auxiliary power unit is charged to the second predetermined threshold value in said another status, said another status being a state where electric power supply to the heat generator is stopped.

3. An image forming apparatus including a fixing apparatus, the fixing apparatus comprising:

a heat generator for receiving electric power supply from a main power source and an auxiliary power unit and generating heat;

a fixing member for fixing toner on a recording medium, the fixing member being heated by the heat generator;

a charging unit for charging the auxiliary power unit with electric power from the main power source, the charging unit being stopped in response to determining that electric energy charged in the auxiliary power unit has reached a first predetermined threshold value when in a standby status; and a control unit configured to control electric power supply to the heat generator, wherein the charging unit is stopped in response to determining that the electric energy charged in the auxiliary power unit has reached a second predetermined threshold value which is greater than the first predetermined threshold value, when in another status.

4. An image forming apparatus, comprising:

a heat generator configured to receive electric power supply from a main power source and an auxiliary power unit to generate heat;

a fixing member configured to fix toner on a recording medium, the fixing member being heated by the heat generator;

a charging unit configured to charge the auxiliary power unit with electric power from the main power source, the charging unit being stopped in response to determining that voltage of the auxiliary power unit has reached a first predetermined threshold value when in a standby status; and a control unit configured to control electric power supply to the heat generator, wherein the charging unit is stopped in response to determining that the electric energy charged in the auxiliary power unit has reached a second predetermined threshold value which is greater than the first predetermined threshold value, when in another status.

5. The heating apparatus according to claim 1, wherein the auxiliary power unit is charged to the second predetermined threshold value in said another status, said another status being a state where a temperature of the heating unit is controlled to be lower than a temperature of the heating unit maintained in the standby status.

6. The heating apparatus according to claim 1, wherein the second predetermined threshold value of electric energy is a maximum value of electric energy capable of being charged in the auxiliary power unit.

7. The image forming apparatus according to claim 3, wherein the auxiliary power unit is charged to the second predetermined threshold value in said another status, said another status being a state where a temperature of the fixing member is controlled to be lower than a temperature of the fixing member maintained in the standby status.

8. The image forming apparatus according to claim 7, wherein the auxiliary power unit is charged to the second predetermined threshold value in said another status, said another status being a state where electric power supply to the heat generator is stopped.

9. The image forming apparatus according to claim 7, wherein the control unit is configured to supply electric power to the heat generator from the main power source and the auxiliary power unit in a returning status following said another status.

10. The image forming apparatus according to claim 3, wherein the second predetermined threshold value of electric energy is a maximum value of electric energy capable of being charged in the auxiliary power unit.

11. The image forming apparatus according to claim 9, wherein when the auxiliary power unit in the standby status following the returning status has not less than the first predetermined threshold value, the auxiliary power unit is not charged until electric energy charged in the auxiliary power unit becomes less than the first predetermined threshold value.

12. The image forming apparatus according to claim 9, wherein when the auxiliary power unit in the standby status following the returning status has less than the first predetermined threshold value, electric energy of the auxiliary power unit is charged up to the first predetermined threshold value in the standby status following the returning status.

13. The image forming apparatus according to claim 7, wherein said another status is an off mode.

14. The image forming apparatus according to claim 3, wherein said standby status is a state where the control unit maintains the fixing member at a temperature capable of forming an image.

15. The image forming apparatus according to claim 4, wherein said another status is a state where a temperature of the fixing member is controlled to be lower than a temperature of the fixing member maintained in the standby status.

16. The image forming apparatus according to claim 15, wherein the auxiliary power unit is charged to the second predetermined threshold value in said another status, said another status being a state where electric power supply to the heat generator is stopped.

17. The image forming apparatus according to claim 15, wherein the control unit is configured to supply electric power to the heat generator from the main power source and the auxiliary power unit in a returning status following said another status.

18. The image forming apparatus according to claim 4, wherein the second predetermined threshold value of voltage is a maximum value of voltage capable of being charged in the auxiliary power unit.

19. The image forming apparatus according to claim 17, wherein when the auxiliary power unit in the standby status following the returning status has not less than the first predetermined threshold value, electric energy of the auxiliary power unit is held without being discharged from the auxiliary power unit in the standby status.

20. The image forming apparatus according to claim 17, wherein when the auxiliary power unit in the standby status following the returning status has less than the first predetermined threshold value, the auxiliary power unit is charged up to the first predetermined threshold value of voltage in the standby status following the returning status.

21. The image forming apparatus according to claim 17, wherein said another status is an off mode.

22. The image forming apparatus according to claim 4, wherein said standby status is a state where the control unit maintains the fixing member at a temperature capable of forming an image.

* * * * *